US007290761B2

(12) United States Patent
Siegel

(10) Patent No.: US 7,290,761 B2
(45) Date of Patent: Nov. 6, 2007

(54) MULTI-PURPOSE FLEXIBLE JAW UNIVERSAL VISE WITH REMOVABLE CLAMP FEATURE

(76) Inventor: Robert P Siegel, 951 Park Ave., Rochester, NY (US) 14610

( * ) Notice: Subject to any disclaimer, the term of this patent is extended or adjusted under 35 U.S.C. 154(b) by 0 days.

(21) Appl. No.: 11/229,603

(22) Filed: Sep. 20, 2005

(65) Prior Publication Data

US 2006/0108729 A1 May 25, 2006

Related U.S. Application Data

(63) Continuation of application No. 10/637,998, filed on Aug. 8, 2003, now Pat. No. 6,953,188.

(51) Int. Cl.
*B25B 5/16* (2006.01)

(52) U.S. Cl. ..... 269/266

(58) Field of Classification Search ..... 269/266, 269/166, 254 CS, 43, 95
See application file for complete search history.

(56) References Cited

U.S. PATENT DOCUMENTS

| | | | | |
|---|---|---|---|---|
| 626,427 | A | 6/1899 | Jones | |
| 1,499,989 | A * | 7/1924 | Lehmann | 269/101 |
| 2,754,708 | A * | 7/1956 | Peterson | 269/224 |
| 4,363,475 | A | 12/1982 | McCarty | |
| 4,418,901 | A | 12/1983 | Woods | |
| 4,572,564 | A * | 2/1986 | Cipolla | 294/88 |
| 4,586,701 | A | 5/1986 | Oncken | |
| 4,752,063 | A | 6/1988 | Nagy | |
| 5,145,157 | A | 9/1992 | Polk | |
| 5,460,064 | A | 10/1995 | Zayat | |
| 5,806,385 | A | 9/1998 | Schupp | |
| 6,032,940 | A | 3/2000 | Wolfe | |
| 6,092,443 | A | 7/2000 | Zayat | |
| 6,098,507 | A | 8/2000 | Lin | |
| 6,138,534 | A | 10/2000 | Cho | |
| D439,487 | S | 3/2001 | Renner | |
| 6,953,188 | B2 * | 10/2005 | Siegel | 269/266 |
| 2005/0029727 | A1 * | 2/2005 | Siegel | 269/266 |
| 2006/0108729 | A1 * | 5/2006 | Siegel | 269/266 |

* cited by examiner

*Primary Examiner*—Lee D. Wilson

(57) ABSTRACT

A multi-purpose clamping device that stabilizes and holds a wide variety of irregularly shaped objects through the use of a stationary and a movable jaw, a linear ratchet and a rotary power cam; both used to engage the work piece, a pair of conformable jaw faces consisting of an array of spring-loaded pins to grasp the work piece, and a base with retractable stabilizing outriggers that ground and stabilize the work. The device is configured in such a way that it will lay flush on one side so that it can be used as a vise in an alternate orientation to allow access from both the top and the side. The base is also configured to allow the clamp portion to detach from the base in order to be used separately as a clamp.

6 Claims, 11 Drawing Sheets

MULTI-PURPOSE FLEXIBLE JAW UNIVERSAL VISE WITH REMOVABLE CLAMP FEATURE

This application is a continuation-in-part of application Ser. No. 10/637,998 filed on Aug. 8, 2003 which is now U.S. Pat. No. 6,953,188 entitled "FLEXIBLE JAW UNIVERSAL VISE".

BACKGROUND OF THE INVENTION

1. Field of the Invention

This disclosure relates generally to vises and, in particular, to a multi-purpose clamping device that stabilizes and holds a wide variety of irregular shaped objects by means of conformable spring action jaws while allowing the clamp portion to detach from the base to be used separately, and configured in such a way that it can be used as a vise in an alternate orientation to allow access from both the top and the side.

2. Background

Woodworking vises and machinist vises are very common and useful tools. Conventional vises rely on a slow and cumbersome method of closure, a non-ergonomic cranking action in a plane parallel to the body of the user. Additionally, they are limited to applications entailing work objects with two parallel sides. Certain specialized jaws are available, such as, notched jaws for holding pipes, or rubber jaws, but for the most part, specialized holding jigs must be built in order to hold irregular objects, which can take considerable time and expense. The device described in the prior application addresses both of those shortfalls, by providing a generalized and flexible holding capability, suitable for a wide range of irregular objects, while providing, a quick and ergonomic method of closure with equivalent or better mechanical advantage.

A further limitation in conventional vises is due to the fact that due to the forces required to open and close them, with the exception of certain types of machinist vises, they must be bolted to a work surface in order to function properly. Therefore, two different vises are required if the functionality of a bench vise is needed, for general purpose work-holdings as well as, a movable vise for securing work to be operated on by a fixed machine such as a drill press. The device described in the present application can be used as a replacement for both a standard bench vise with the added functionality of being able to hold non-standard shapes, and it can be configured as a movable vise that can address a fixed machine such as a drill press. The device also allows for a secondary orientation which, when turned on its side, allows through access from the top which is convenient for drilling.

Clamping devices that exist today consist of vises and clamps as separate devices, a vise being essentially a larger clamp that is securable to a base. The device of the present disclosure can be used both as a vise and a clamp, since the clamp portion of the vise can be removed from the base, with the further benefit that both the clamp and the vise are capable, due to their unique, spring-loaded pin jaws, of holding irregularly shaped work objects.

A wide variety of specialized holding and clamping devices have been developed in an attempt to accommodate irregularly shaped objects. Examples of such devices are found in U.S. Pat. Nos. 5,460,064, 5,806,385, 6,098,507, 6,092,443, and 6,138,534. While these and other devices represent and improvement in the art of holding irregularly shaped objects, they suffer from several drawbacks that have prevented widespread application in the machining arts.

U.S. Pat. No. 6,264,27 to E. H. Jones, issued Jun. 6, 1899 is directed to a vise in which an article is placed between two jaws provided with adjustable projections (or between a single jaw and a plane jaw) and the jaws are moved together, so that the article displaces the projections opposite to it and their ends bear on the different portions of its form and hold it up approximately as a mold would do. The projections are then clamped securely in the projections to which they have adjusted themselves and the jaw is tightened upon the article by a vise screw.

U.S. Pat. No. 1,499,989 to F. Lehmann, issued Jul. 1, 1924 discloses a vise for use with machine tools that includes a base plate adapted to be secured to the sliding carriage of a planing machine, or the like, and having two housings mounted oppositely on the base plate. The two housings are adapted such that at least one will slide toward the other and a series of spring controlled clamping jaws are so arranged in each of the housings that projecting parts of the workpiece causes part of the jaws to be pressed back into the housings until all of the spring controlled jaws are in contact with and firmly grip the workpiece on all sides.

U.S. Pat. No. 2,754,708 to C. R. Peterson, issued Jul. 17, 1956 shows a vise for handling irregular shaped object that includes a base having a stationary jaw projecting upwardly from one end and a movable jaw slidable on the base. Included in each of the jaws is a hollow block having facing openings with a plurality of movable work engaging members slidably carried in the block. A movable pressure plate in each block adjacent one side wall thereof is clampable against the work engaging members to lock each of them into work engaging position. Springs are used to urge each work-engaging member into working position.

U.S. Pat. No. 4,752,063 to Bela Nagy, issued Jun. 21, 1988 is directed to a vise attachment for use on a vise assembly for holding objects having irregularly shaped surfaces and includes a small compact housing having a plurality of blade elements disposed adjacent to each other and slidably mounted within a rectangular opening on one side of the housing and movable between and extended position and a retracted position. Each element preferably comprises a plate member having smooth planar surfaces and a concave curved back edge and stop means disposed on upper and lower edges for setting a limit for extension of the blade from the housing. A self-distributing non-resilient medium is positioned within the housing and has a predetermined volume for filing the housing when the blades are in a retracted position. A distribution and reset means causes the blades to reposition themselves to extend fully through the rectangular opening when not holding an object.

U.S. Pat. No. 6,032,940 to Ingo E. Wolfe, issued Mar. 7, 2000 discloses a universal vise that has a movable and a fixed jaw that can be indexed at 90° increments to provide for four separate work clamping surfaces on each jaw. The vise includes a vise screw driving a nut that drives the movable jaw in each of four indexed positions of the movable jaw. The indexable jaws permit the vise to be adapted to hold four different types of work pieces.

U.S. Des. Pat. No. D/439,879 to Reinhard Renner, issued Mar. 27, 2001 discloses a gripping clamp that utilizes a linear slider bar, a moveable jaw and a fixed jaw that can be tilted by means of a ratchet cam.

U.S. Pat. No. 4,363,475 to Robert McCarty, issued Dec. 14, 1982 describes a vise-like C-clamp which consists of a C-clamp mounted to a base in such a way as to allow the clamp to be held in horizontal, vertical and angled orientations. These orientations are rotated around an axis that is horizontally perpendicular to the device itself. The clamp comes with a number of different gripping heads to allow engagement with a variety of work object shapes.

U.S. Pat. No. 4,586,701 to Harold Oncken, issued May 6, 1986 describes a drill press vise equipped with a means of locating and securing a work piece with respect to the drill axis, based on a rectangular frame and a fixed and movable jaw that can be translated or rotated with respect to the vertical axis of the drill press. Various means including hydraulics and screw threads are provided to move the movable jaw with respect to the fixed jaw and thus provide clamping.

U.S. Pat. No. 5,145,157 to James D Polk, issued Sep. 8, 1992 describes a drill press vise with a number of parallel fingers elements configured in a single row that can accommodate around a moderately irregular shape. The fingers are slidable and can be clamped into a fixed position by means of a screw located at the side of the jaw.

U.S. Pat. No. 4,418,901 to William Woods, issued Dec. 6, 1982 describes a drill press vise configured such that the jaws can be twisted out of the plane of the table to allow for drilled holes at compound angles. While the above-described vise devices are effective for their intended purpose, there is nevertheless a continuing need, and a consumer desire, for an improved vise that opens and closes quickly and easily with a high degree of mechanical advantage is usable for clamping and holding a wide variety of work object shapes, that also has a detachable clamp and the ability to be turned on its side so as to provide through-access for applications such as holding objects on a drill press where the vise base might otherwise be in the way.

SUMMARY OF THE INVENTION

Accordingly, a Flexi-vise is disclosed comprising a stationary and movable jaw that can be easily opened and closed primarily with a linear ratchet shaft and secondarily with a rotary power cam. The jaws are designed, with each jaw having upstanding portions to accommodate a variety of interchangeable jaw faces including a jaw face containing an array of spring loaded pins. The spring-loaded pins enable the vise to grasp objects of widely varying shapes. The vise is designed to easily accommodate a variety of such jaw faces with differing force-displacement characteristics, such as, but not limited to light, medium and heavy duty, with respect to clamping force capability. Various spring-pin excursion lengths can be used to accommodate more different shapes and different spring rate characteristics. Additionally, a flat face can be installed to provide a more typical vise configuration. The linear ratchet slide mechanism that is employed allows the jaws to be brought quickly to a point where the load is engaged. Ratchet teeth or a knurled or roughened surface on top of the linear ratchet bar in conjunction with a spring-loaded dog ensures that the initial load on a work object is maintained. This initial load can be released by means of a spring-loaded dog attached to the stationary jaw. A rotary power cam is provided to significantly amplify the final clamping action. The vise is configured in such a way that the clamping portion described above can be removed from the base to serve as a stand-alone clamp. The vise also has the capability to be configured such that the jaws can be aligned down the middle of the base to be used upright with maximum stability, or they can be aligned with the edge of the base so that the vise can lay flat on its side to provide through-access for vertical operations as would be the case with a drill press. These and other features and advantages are described in or apparent from the following detailed description of the exemplary embodiments.

BRIEF DESCRIPTION OF THE DRAWINGS

The foregoing and other features of the exemplary embodiments will be apparent and easily understood from a further reading of the specification, claims and by reference to the accompanying drawings in which like reference numerals refer to like elements and wherein:

DETAILED DESCRIPTION OF THE INVENTION

Figure 1:
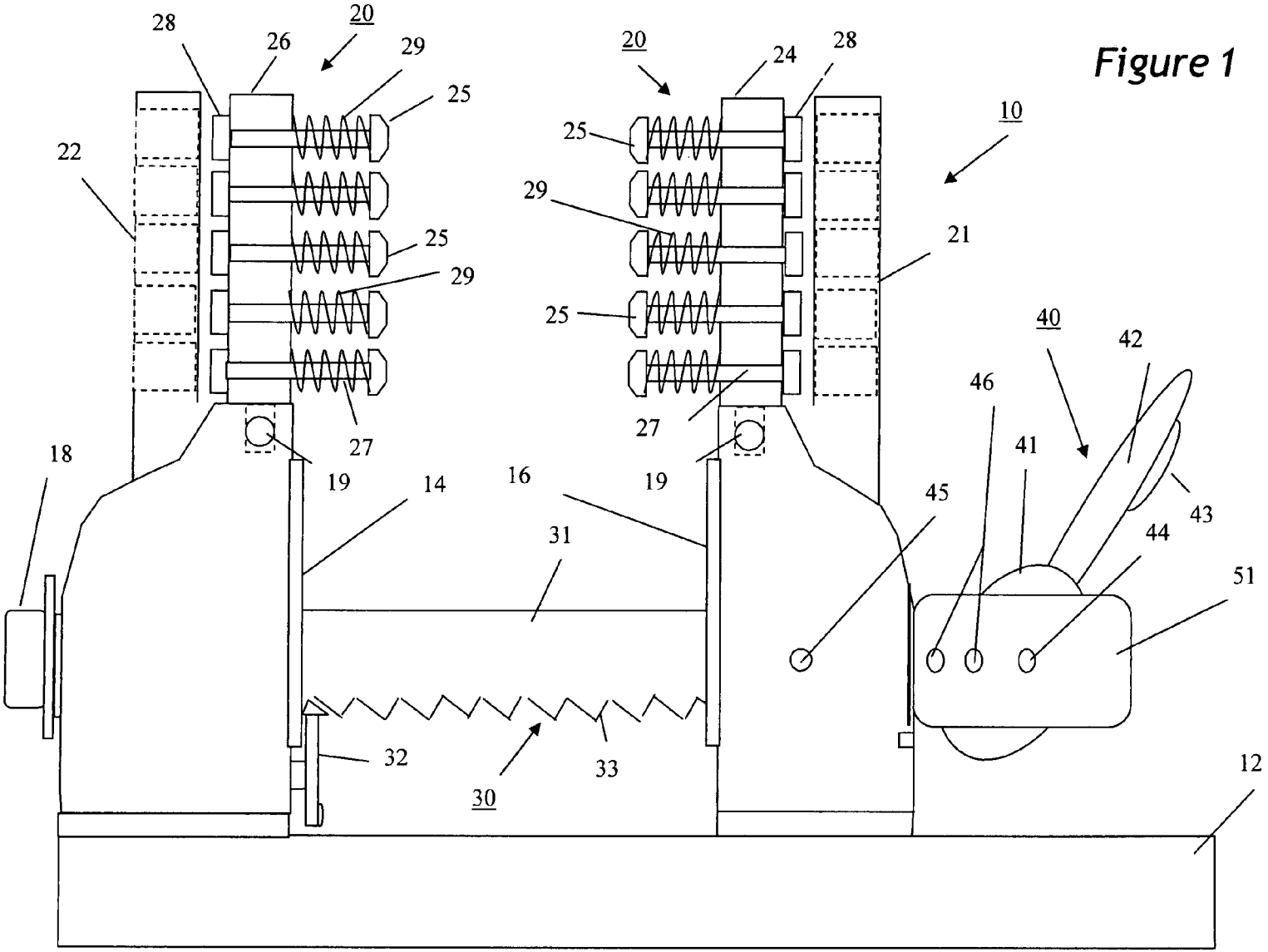
FIG. 1 is a schematic side view of a Flexi-vise apparatus.

While preferred embodiments will be described hereinafter, it will be understood that it is not intended to limit the invention to those embodiments. On the contrary, it is intended to cover all alternatives, modifications, and equivalents as may be included within the spirit and scope of the disclosure as defined by the appended claims.

For a general understanding of the features of the exemplary embodiments, reference is made to the drawings. In the drawings, like reference numerals have been used throughout to identify identical elements. FIGS. 1-11 schematically depict various views illustrating an improved vise incorporating the features of the present invention therein. It will become evident from the following discussion that the disclosed vise may be employed in a wide variety of applications for holding irregular objects and is not specifically limited in its application to the particular apparatus and method specifically mentioned herein.

Figure 2:
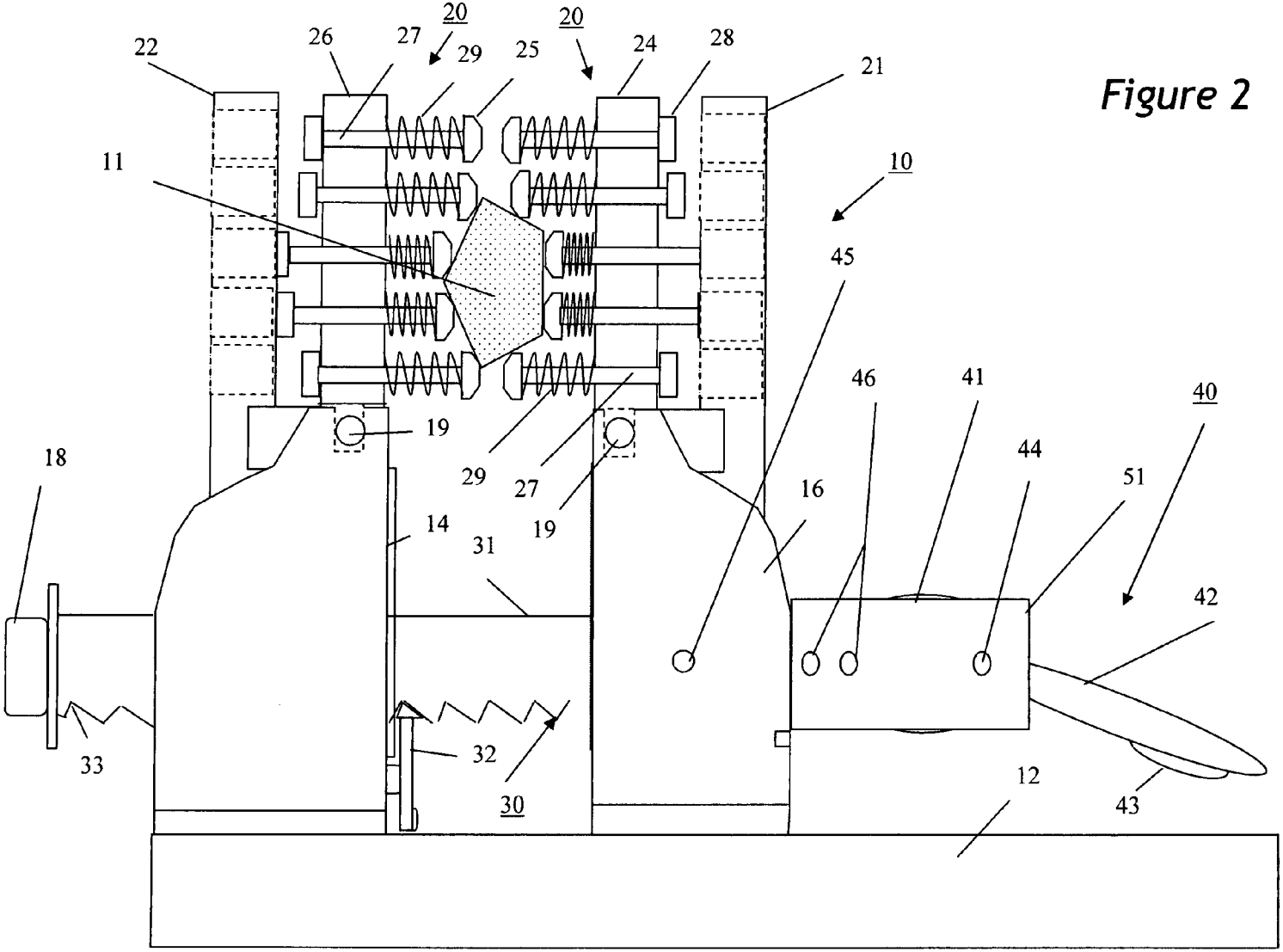
FIG. 2 is a schematic side view of the Flexi-vise of FIG. 1 showing the Flexi-vise loaded with a work piece of a non-standard shape.

Referring now to FIGS. 1-11, various views are shown illustrating the Flexi-vise 10. In FIG. 1, a base 12 supports a pair of opposing, parallel jaws 14 and 16. One jaw 14, is fixed, while the other 16, is moveable. The jaws are designed to accommodate a variety of quick-release jaw faces that can be used for a variety of applications. In the preferred embodiment, a removable jaw face assembly 20 containing a dense array of spring loaded-pins 27 is installed. Each pin passes through a compression spring 29 within which it has a loose sliding fit. The pin-spring arrangement passes through clearance holes in face plate 24 in movable jaw 16 and 26 of stationary jaw 14 and is held there by an end cap 28 which can either be formed as part of the pin, or removable. Flexi-vise 10 is opened and closed, by a combination of a linear ratchet mechanism 30 and a cam 40. A stabilizing outrigger 83 is shown in the stowed position. As shown in FIG. 2, as the vise closes, pins 27 conform around a work object 11, providing an increasingly secure grasp as first, the movable jaw 16 is pushed toward stationary jaw 14 along the ratchet shaft 31, then, it is further secured by means of the cam 41 which displaces the moveable jaw 16, as the cam lever 42 is depressed. This dual action provides a secure grasp of the work object 11 by the pins 27 between the jaws.

Each pin 27 is retractable independently from the others, allowing the work object to imprint its shape into the bed of pins. This will occur on both jaws. The amount of deflection will depend on the shape of the object, the stiffness of the springs and the degree to which the jaws are closed.

A variety of jaw face assemblies can be made with various pin and spring combinations that can extend the range of Flexi-vise 10 to not only multiple shapes, but also to a broad range of holding force requirements. For example, very light springs and pins can be used to securely hold delicate objects, for light tasks, such as, painting, light assembly or adjustment. Heavier holding forces can be provided using heavier springs and pins for tasks entailing higher loads such as cutting, drilling, filing or heavy assembly. Medium duty jaw face assemblies can be used for general assembly work for complex object shapes, such as, the assembly of wire harnesses. In addition, the tips 25 of the holding pins 27 can be constructed differently for the different applications. Rubber tips might be used for the light duty version. Hard plastic tips can be used for the medium duty version and steel tips for the heavy-duty version.

It should be understood that a Flexi-vise 10 with a set of easily interchangeable jaw face assemblies is proposed, although a single-purpose Flexi-vise could also be constructed with any one of the jaw face assemblies described above or one of a similar nature.

The length of the retractable pins minus the fully compressed or solid length of the spring will determine the degree of non-uniformity of the work object to be held, since as soon as any pin "bottoms out", the vise can close no further.

The forces on the object will be non-uniform, to the degree that the object is non-uniform. However, given the large number of pins, the distributed holding forces on the work object will generally be quite substantial. To the extent that the work object is non-uniform, pins 27 will provide lateral support only achieved in an ordinary clamping vise by means of high, and potentially destructive clamping forces.

Retaining pins 21 can used to secure the detachable clamp from the base 12, by means of the mounting pins 22 (shown as hidden lines).

Figure 3:
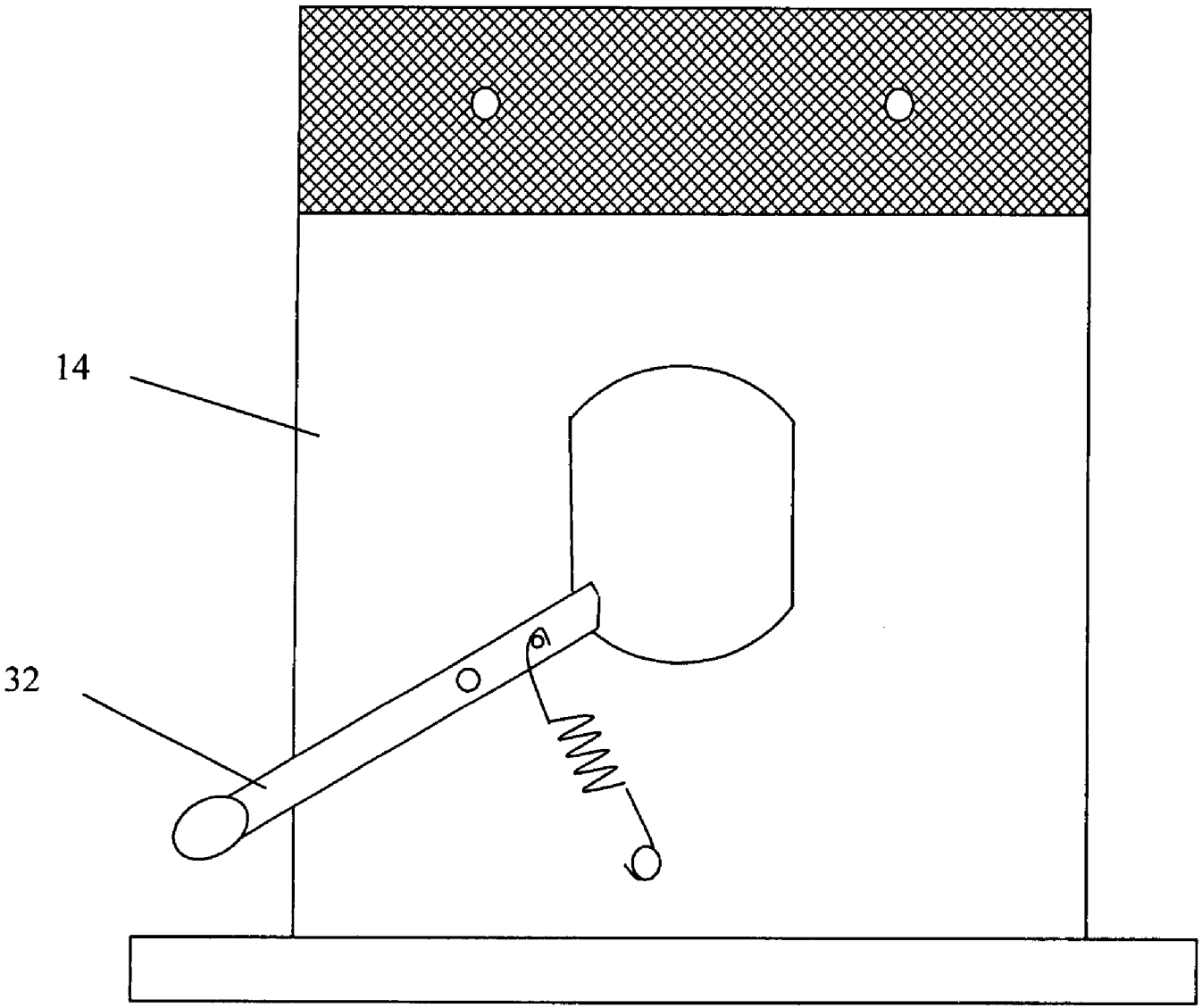
FIG. 3 is a schematic end view of the stationary jaw of the Flexi-vise shown in FIG. 1 showing the linear ratchet release mechanism.

As shown in FIGS. 1-3, Flexi-vise 10 is also unique by the means provided for opening and closing the vise. Instead of the traditional threaded shaft that is generally used to drive a vise closed, a ratchet-cam system is employed. The major advantage of the threaded drive is its mechanical advantage. The disadvantage is the amount of time it can take to open or close the jaws: The required motion, which describes a circle parallel to the user's body, is also awkward. The arms can generate far more power in a plane perpendicular to the plane of the body.

Figure 4:
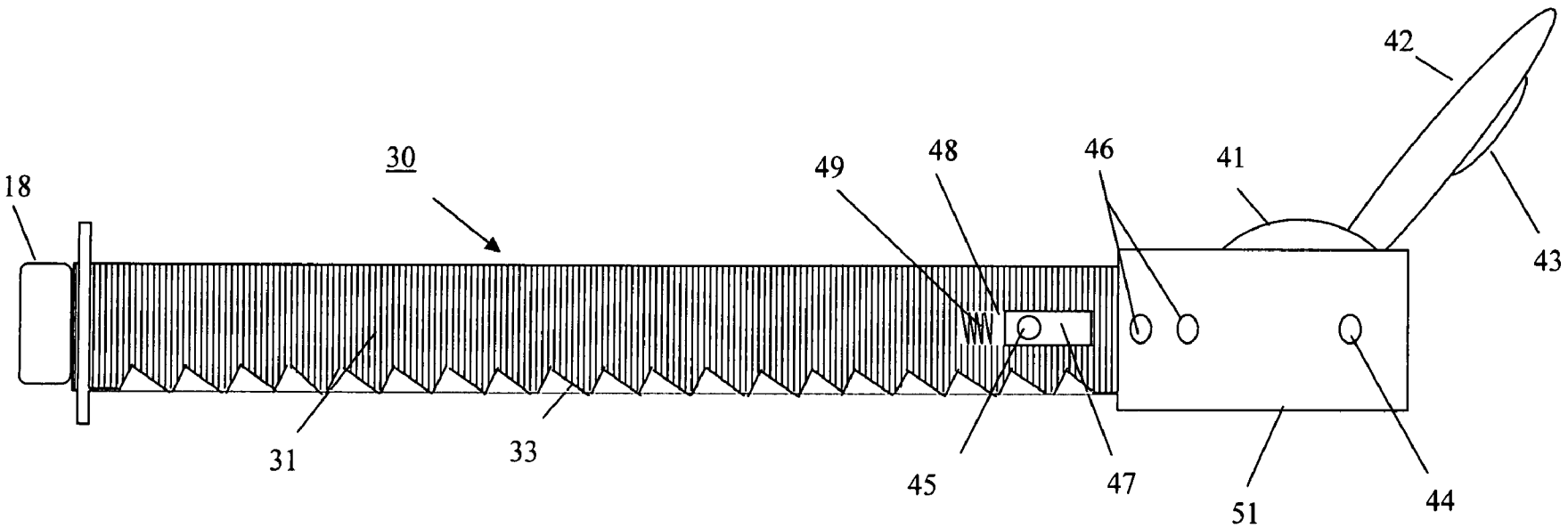
FIG. 4 is a schematic side view of the linear ratchet bar assembly shown in FIGS. 1 and 2.
Figure 5:
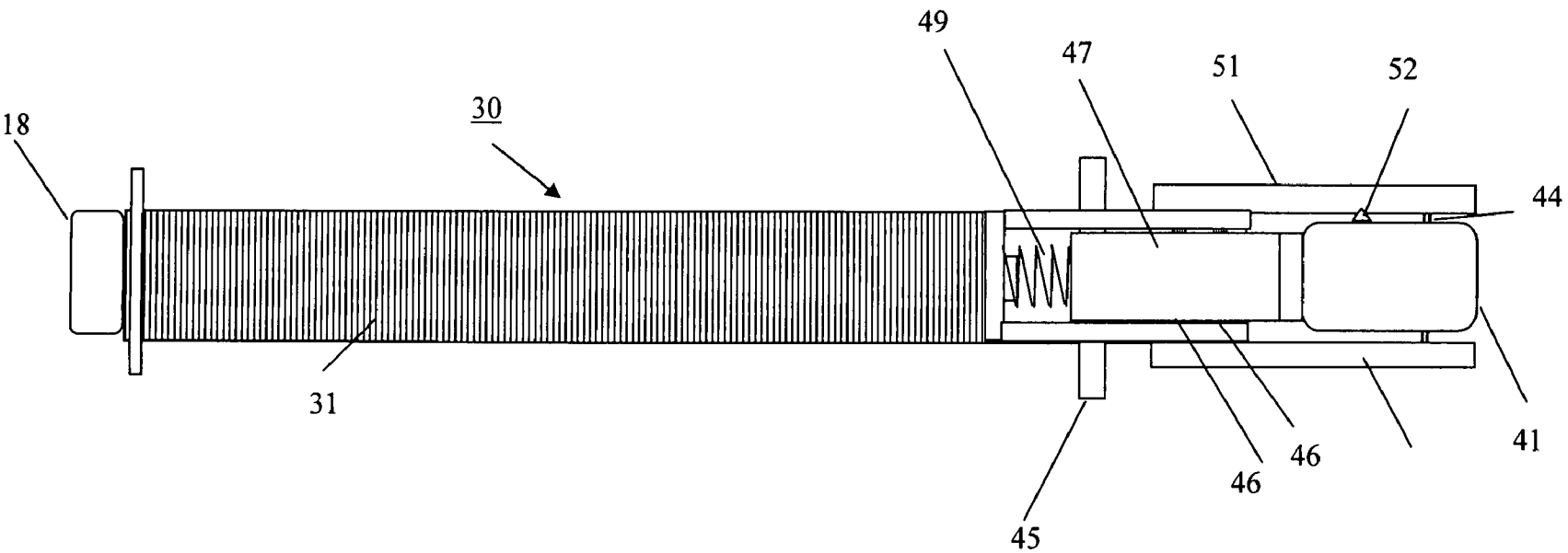
FIG. 5 is a schematic plan view of the linear ratchet bar assembly shown in FIGS. 1 and 2.
Figure 6:
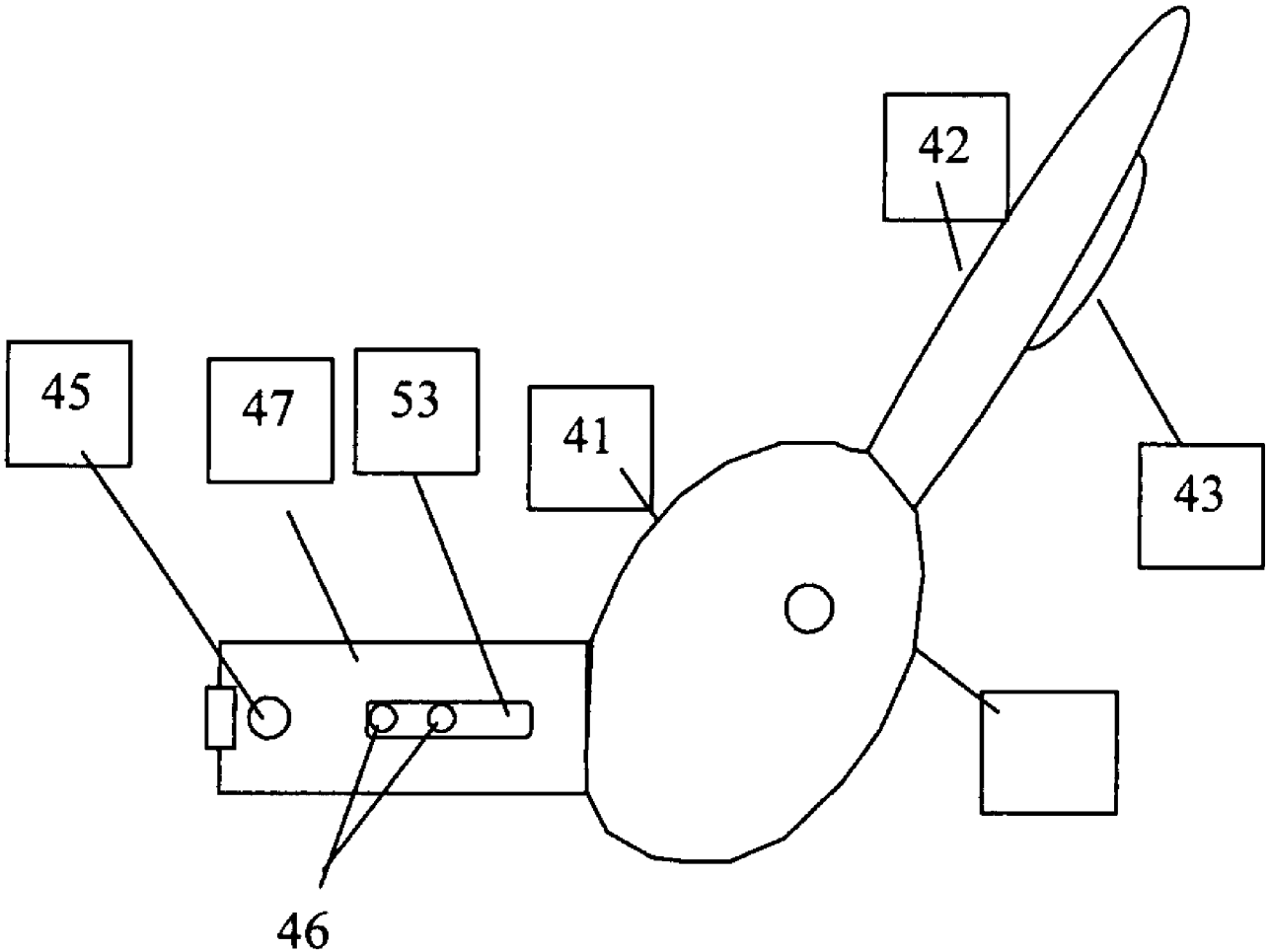
FIG. 6 is a side view detail of the ratchet cam and piston arrangement.

In the ratchet-cam system, the main drive is achieved by a linear ratchet mechanism 30 that includes the ratchet shaft 31, which takes the place of the conventional threaded drive shaft. As shown in FIGS. 1-2, shaft 31, which has a diameter similar to that of a typical vise screw, has flats on the sides to prevent rotation, and a series of parallel slots that intersperse a series of raised surfaces 33 that act as teeth. Teeth 33 may have a ratchet profile, which is to say, a gentle slope in the direction that motion is being permitted (closing the jaws) and a steep profile in the direction that motion is being suppressed (opening the jaws). The teeth do not need to be deep and given the mechanical forces that tend to lock the shaft when force is applied, a roughened or knurled surface would be sufficient. Movable jaw 16 is engaged on this linear ratchet shaft and moves with the shaft 31 as the entire linear ratchet mechanism 30 is slid forward. A spring-loaded dog 32, shown in FIG. 3 mounted on fixed jaw 14, is used to engage teeth 33, thus avoiding back slip as the jaws begin to engage the load. The dog is released by release lever 34 which is held in position by torsion spring 35. FIGS. 4-6 show the ratchet bar drive assembly details. This drive action is significantly faster than traditional vises which utilize screw drives. The cam mechanism 40 of the ratchet-cam system includes a rotary cam 41 that compensates for this. The ratchet cam 41 has a short throw (typically less than one inch depending on the specific cam profile). It is intended to be deployed after the movable jaw 16, riding on the linear ratchet shaft 31 has engaged work piece 11 and it either closes to the final load point, or, as far as the user is able to push it shut against the resisting force of the springs 29. However far Flexi-vise 10 is closed at this point, it will remain closed by virtue of ratchet bar 31, and spring-loaded dog 32 engaging the ratchet teeth 33. Once deployed, the ratchet cam 41, also remains loaded by virtue of the over-center geometry provided by the cam.

The movable jaw 16 is pinned to a piston 47 that rides inside ratchet shaft 31 by means of the drive pin 45. The drive pin 45 passes through a slot 48 in the ratchet shaft rather than a hole. This allows the movable jaw to translate with respect to the shaft, a distance that is comparable to the linear "throw" of the ratchet cam 41, and independently of the linear ratchet shaft position, This is important since it does not disturb that "locked" state achieved by the linear ratchet mechanism. The cam 41 sits inside a cutout in linear ratchet shaft 31. A compression spring 49 maintains a biasing force against the piston 47.

The cam 41, can be deployed by manipulating cam lever 42 to increase the loading of the jaws by means of a cam action with a mechanical advantage, that approximates that of a traditional screw drive.

The cam mechanism 40 uses an over-center design to lock down and hold any forward progress made by the user as a clamping force is exerted with cam lever 42. The cam mechanism 40 is oriented in a vertical plane so that the user can put body weight into it as cam lever 42 is pressed down. Cam pivot shaft 44 is affixed to the linear ratchet shaft 31 by means of the two cam mounting plates 51. The cam 41, when rotated, pushes against the piston 47, which slides inside the ratchet shaft 31. The piston 47 drives the moveable jaw 16 forward by means of the drive pin 45, which is free to move forward through the slot 48 in the ratchet shaft.

There is also a slot 53 in the piston 47 that retains it and aligns it to the ratchet shaft 31 by means of the two piston engagement pins 46. The slot 53 allows it to slide forward in response to the cam 41 action.

As shown in FIG. 6, The slot 53 in the piston 47 is used to capture and align it with respect to the ratchet shaft 31.

Figure 7B:
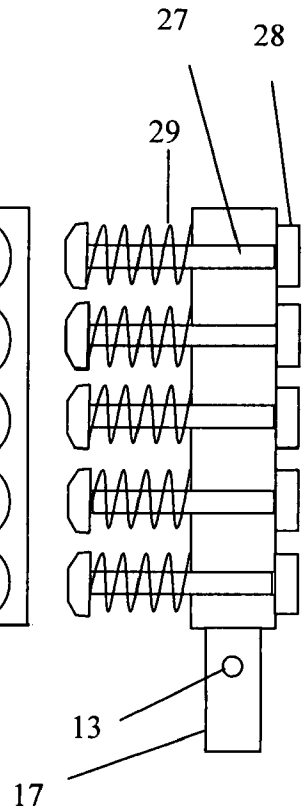
FIG. 7B is a side view of the spring-loaded pin array jaw face shown in FIG. 7A.
Figure 7A:
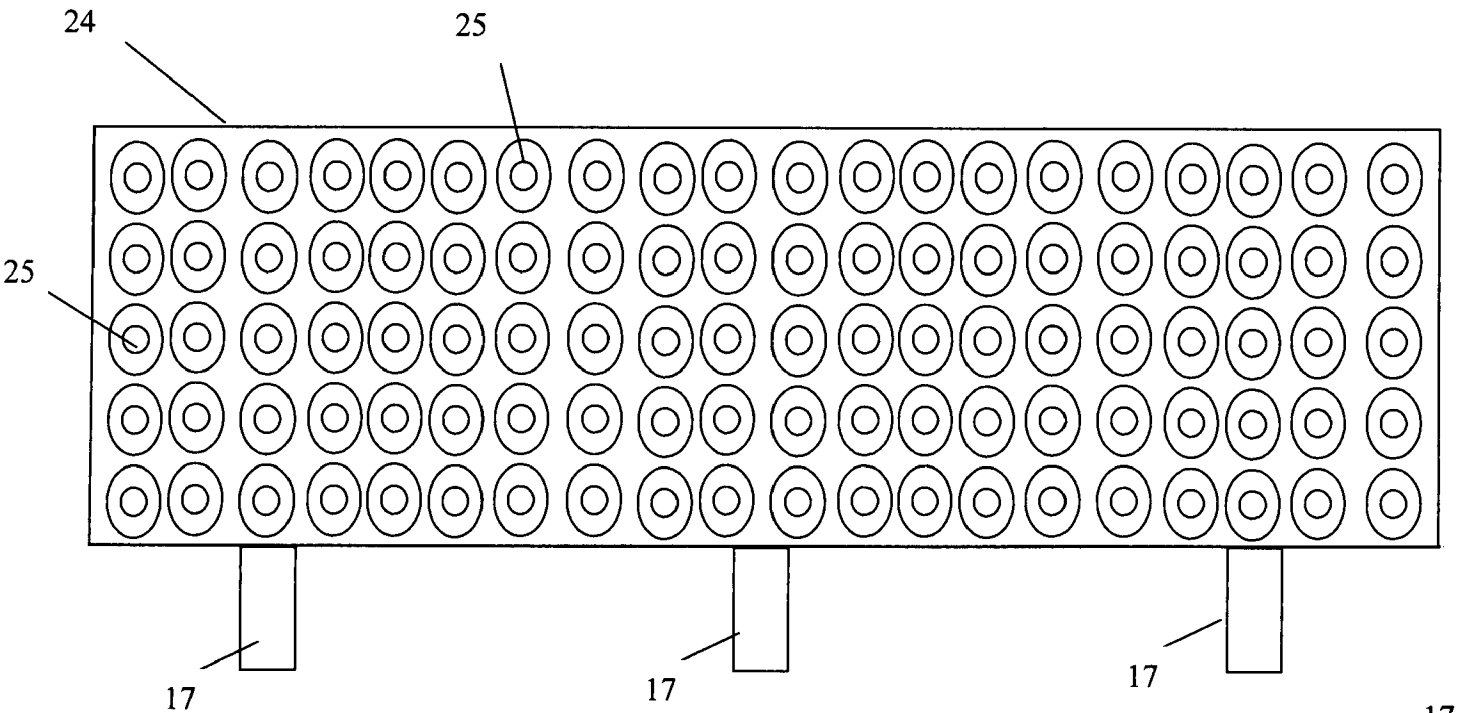
FIG. 7A is a front view of a typical spring-loaded pin array jaw face of the Flexi-vise of FIG. 1 showing the loading pin ends and the quick-release mounting pins.

FIGS. 7A and 7B show the front and side views, respectively, of spring-loaded jaw face 24. In these views, pins 17 that are used to mount the jaw face onto moveable jaw 16 can be seen.

Figure 8:
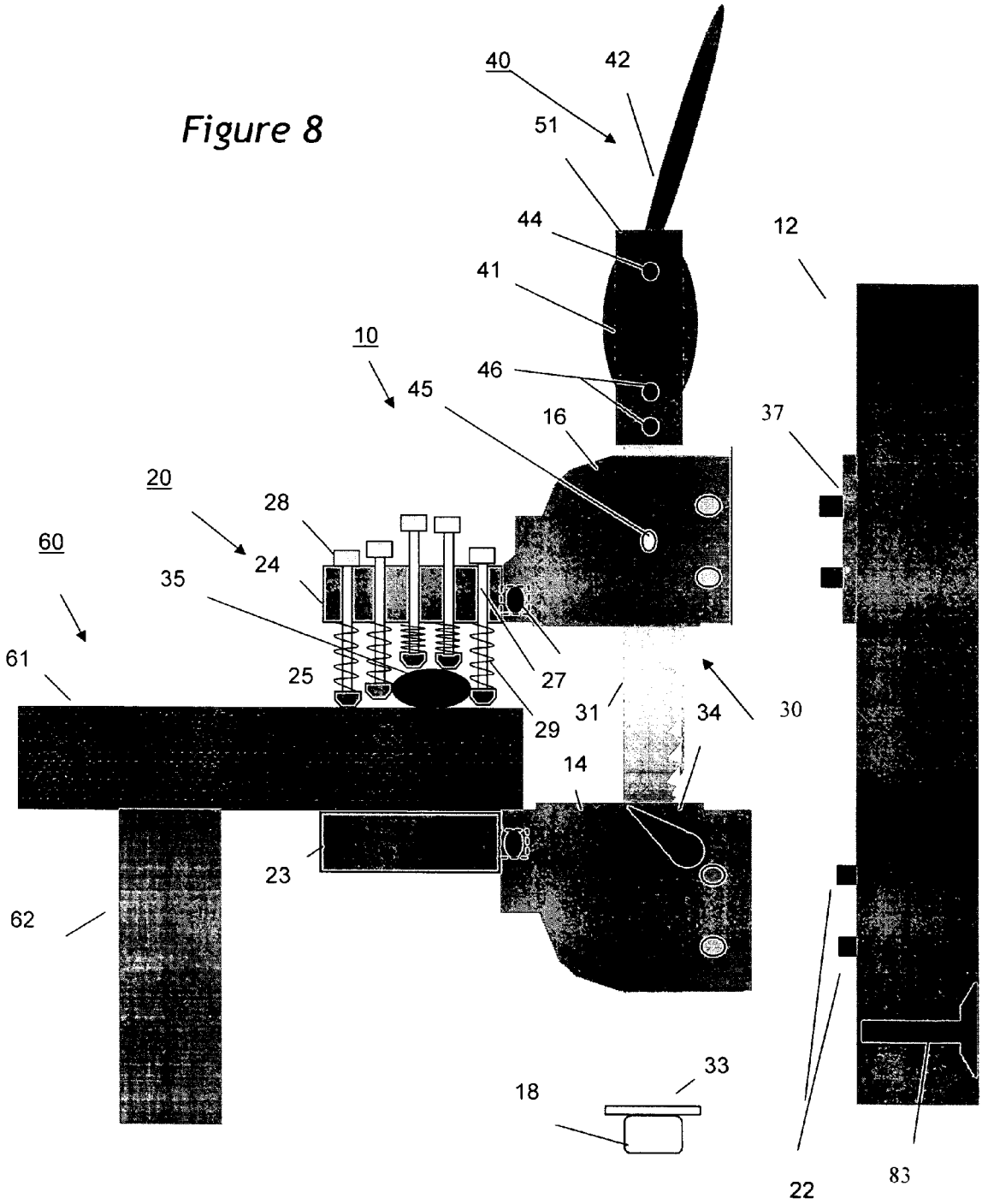
FIG. 8 is a rotated side view of the vise with the clamp portion detached and deployed in clamping an oval-shaped object against the top of a work table.

FIG. 8 is a rotated side view that shows the detachable clamp portion of the vise separated from the base 12, and engaging an oval-shaped work object 35 upon a work table. The table top 61 and a table leg 62 are shown for illustrative purposes. In this figure a flat jaw face 23 is inserted into stationary jaw 14 to engage with the flat underside of the table while a standard spring-action jaw engaged the oval-shaped work object. The retaining pins 22 that hold the detachable clamp to the base can also be seen in this view. The carrier 37 that attaches the movable jaw 16 to the base 12 in a slidable manner remains connected to the base 12 in this mode.

Figure 9:
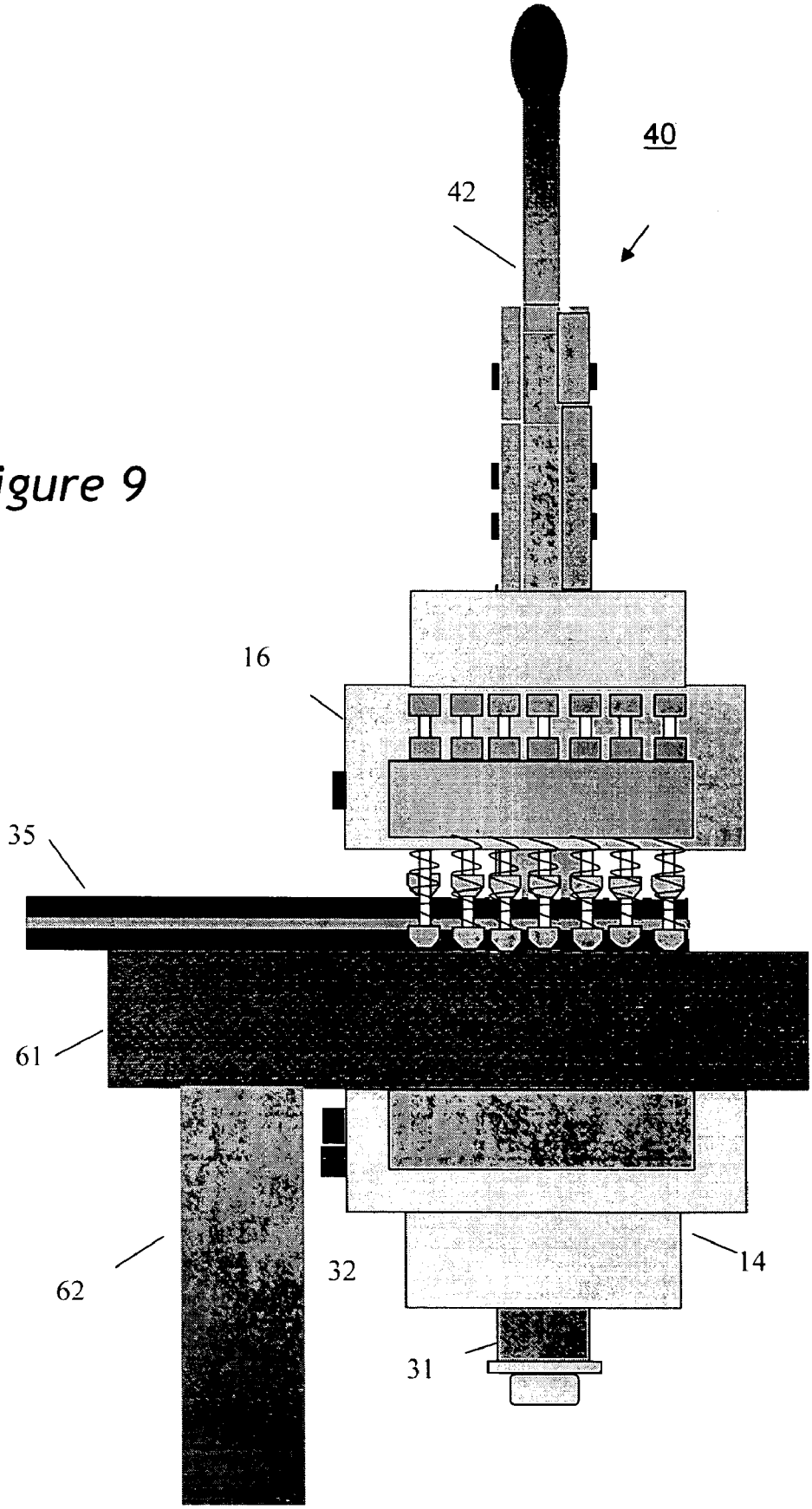
FIG. 9 is an end view of the detachable clamp portion deployed against a work surface holding an oval-shaped object.

FIG. 9 shows the same items from an end view looking in at the top of the clamp.

Figure 10:
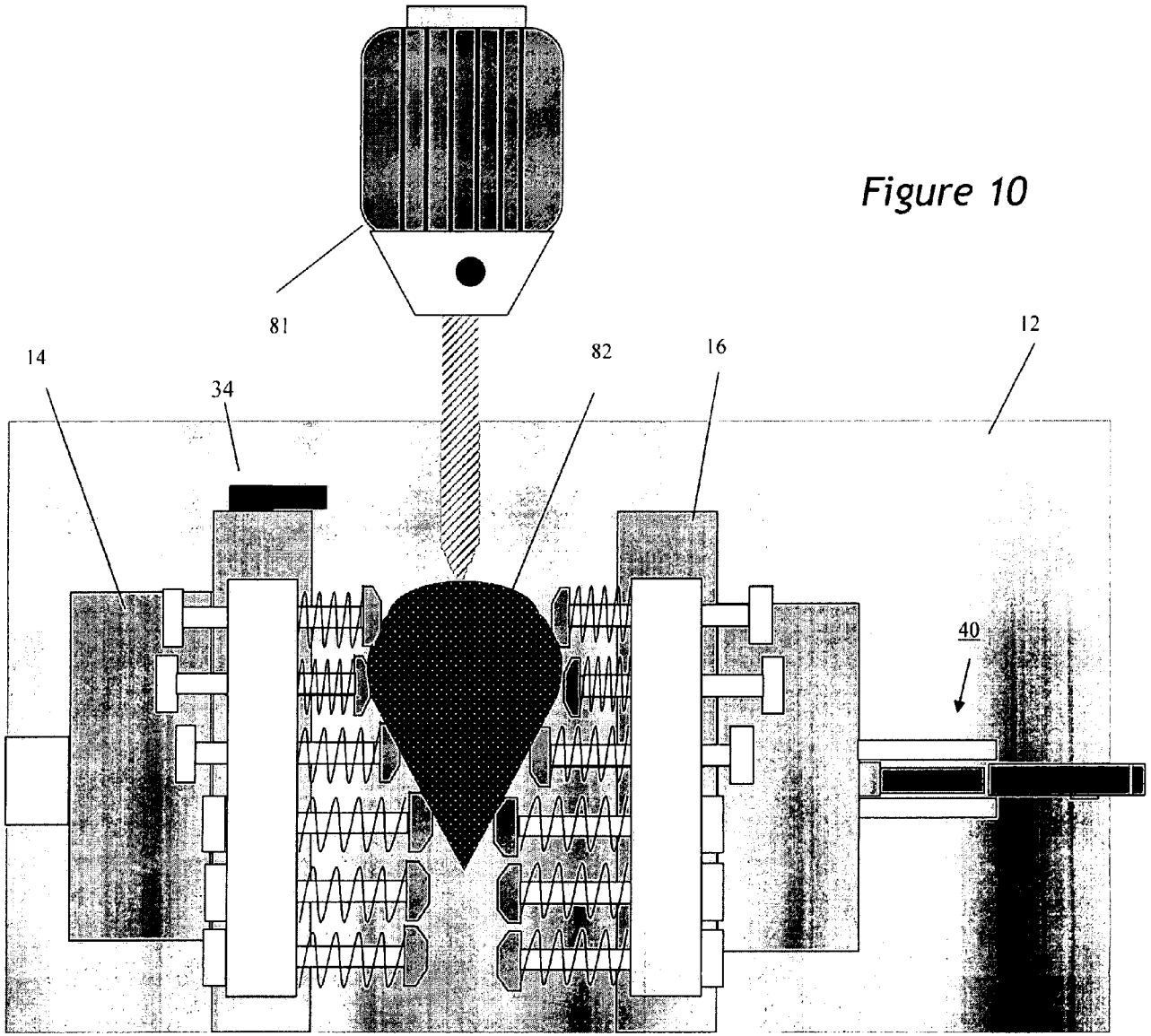
FIG. 10 is a schematic side view showing the Flexi-vise from the top, turned on side, laying flat against a drill press platen and holding an irregular object to be operated upon by a drill press.

In FIG. 10, the Flexi-vise is shown from the side, turned on its side to accommodate a drill press operation. For illustrative purposes, the drill press head 81 is shown. With this configuration, the drill can pierce through the work object 82 without any risk of contacting any portions of the vise. In this configuration, the clamp portion of the vise is mounted on the base in such a way that one side of the clamp jaws 14,16 is flush with the edge of the base 12 so that the vise will lay flat on its side.

Figure 11:
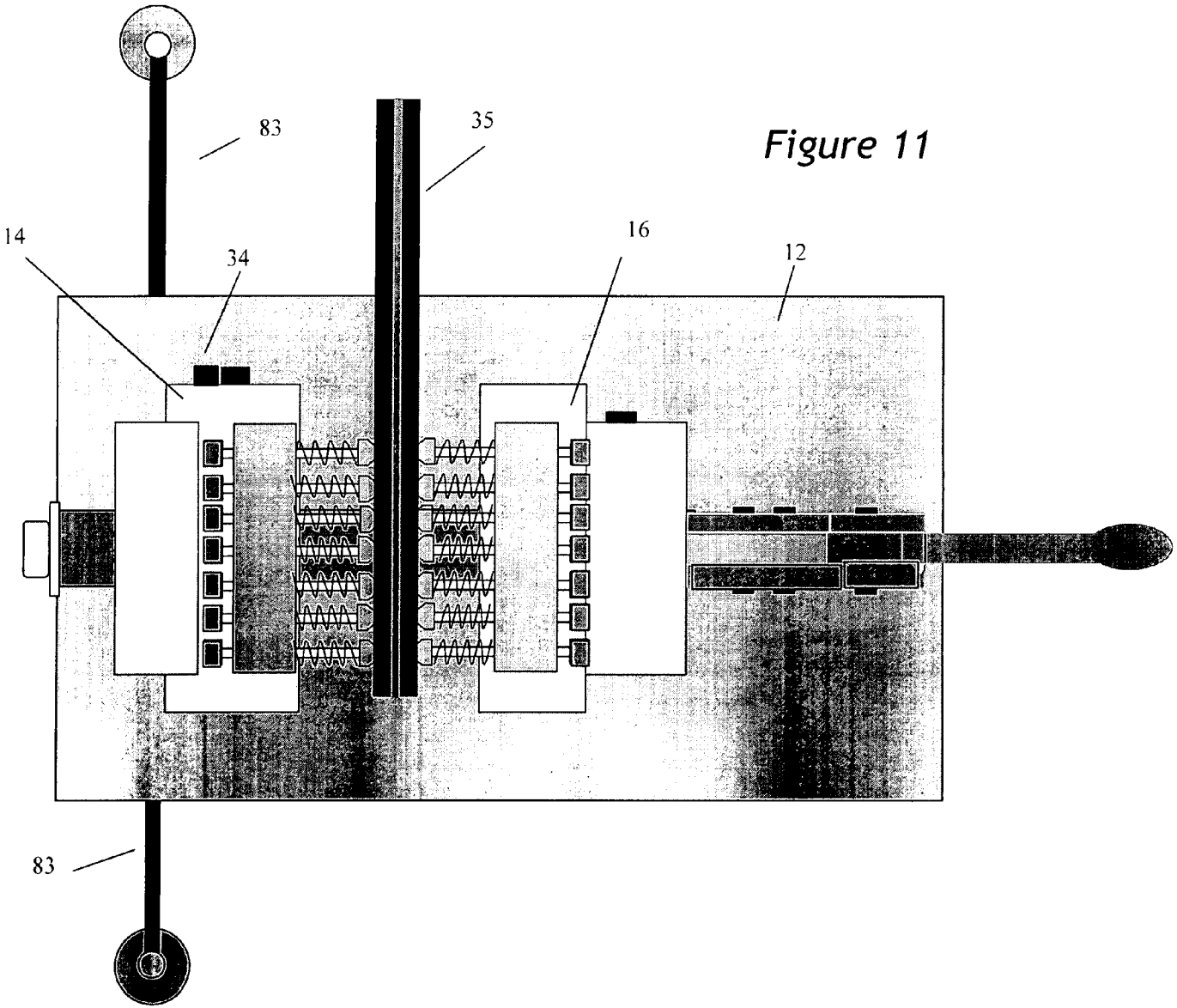
FIG. 11 is a top view of the Flexi-vise showing the self-storing, stabilizing outriggers deployed.

FIG. 11 Shows the vise from a top view which allows the stabilizing outriggers 83 to be shown. These outriggers which self-store into the base when not being used, serve to stabilize the vise during portable use and keep it from tipping over when long work object is in the jaws. Note that in this figure the vise is configured such that jaws 14,16 align with the center of the base 12 for improved stability.

In recapitulation, a Flexi-vise having a unique means of rapidly and conveniently closing vise jaws to grasp and secure an object that utilizes a linear ratchet shaft, a secondary securing step utilizing a cam to provide, a powerful clamping action, a flexible system of quick release jaw face assemblies including one with spring loaded pins, capable of accommodating a variety of application-specific requirements. The spring-loaded pins enable the vise to grasp objects of widely varying shapes. The vise can accommodate a variety of jaws with differing force-displacement characteristics, such as, but not limited to light, medium and heavy duty, with respect to clamping force capability. Various spring-pin excursion lengths can also be provided, to accommodate more different shapes and different spring rate characteristics. Flat face jaws can also be used. A simple arrangement such as a set of tight fitting pins with a cross-locking engagement pin can be used to mount the jaws. A linear ratchet slide mechanism is employed that allows the jaws to be brought quickly to a point where the load is engaged. The ratchet teeth ensure that the initial load on the object is maintained. This initial load can be released by means of a spring-loaded dog attached to the movable jaw. A rotary cam is provided to significantly amplify the final clamping load. The vise is designed in such a way that the jaws can be biased along one edge allowing the vise to lay flat on its side, providing through-access for applications such as that for a drill press, or the jaws can alternatively be aligned along the centerline of the base for improved stability. A further feature of this vise is that the clamping portion of the vise can be detached from the base to provide a separate clamp with all the Flexi-vise features, particularly the ability the engage and hold work objects of non-uniform and irregular shape.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

I claim:

1. A device for clamping or securing regular and irregular shaped work objects, comprising:

A base member;

A pair of jaws projecting upwardly from said base member, and wherein at least one of each of said pair of jaws includes a plate and an array of spring loaded pins therein that, when driven along a bar and actuated by means of a cam arrangement including a lever and a cam which allows the jaws to grasp work objects of regular and irregular shapes; and Wherein said base member is detachable from said pair of jaws in order to turn said device into a clamp.

2. The device of claim 1, wherein the alignment between the jaws and the base is such that one side of each jaw is flush with the base which enables the vise to lay flat on one side permitting a user to use said device with through access between said pair of jaws as in a drill press vise.

3. The device of claim 2, wherein said base member includes stowable, retractable outriggers that prevent said device from tipping during use.

4. A vise, comprising:

a base member;

a stationary jaw and a movable jaw projecting upwardly from and slidable on said base member;

a slide mechanism connecting said stationary jaw to said movable jaw, said slide mechanism being adapted to allow quick movement of said movable jaw towards said stationary jaw to a point where a work object is engaged;

a cam arrangement including a lever with a cam which engages said slide mechanism to thereby displace said movable jaw towards said fixed jaw; and Wherein said base member is detachable from said stationary jaw and a movable jaw in order to turn said vise into a clamp.

5. A vise, comprising:

a base member;

a stationary jaw and a movable jaw projecting upwardly from and slidable on said base;

a linear ratchet slide mechanism connecting said stationary jaw to said movable jaw, said linear ratchet slide mechanism being adapted to allow quick movement of said movable jaw towards said stationary jaw to a point where a work object is engaged;

and a ratchet cam arrangement wherein said ratchet cam comprises a lever with a cam which engages a piston within said linear ratchet slide mechanism thereby displacing said movable jaw towards said fixed jaw; wherein said base member is detachable from said stationary jaw and a movable jaw in order to turn said vise into a clamp.

6. The vise of claim 5, wherein in said first mode alignment between said upwardly projecting jaw and said base member is such that one side of each of said jaws is flush with said base member which enables said vise to lay flat on one side permitting a user to use said vise as a drill press vise with through access between said pair of jaws.

* * * * *